US008303358B1

(12) United States Patent
Hung

(10) Patent No.: US 8,303,358 B1
(45) Date of Patent: Nov. 6, 2012

(54) CONNECTOR MODULE AND CONNECTOR

(75) Inventor: Hsu-Tsung Hung, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 13/331,794

(22) Filed: Dec. 20, 2011

(30) Foreign Application Priority Data

Nov. 29, 2011 (CN) ..... 2011 1 0386608

(51) Int. Cl.
*H01R 13/46* (2006.01)

(52) U.S. Cl. ..... 439/892; 439/521

(58) Field of Classification Search ..... 439/499, 439/521, 892, 901
See application file for complete search history.

(56) References Cited

U.S. PATENT DOCUMENTS 7,399,193 B1 * 7/2008 Ho et al. ..... 439/260
7,722,373 B2 * 5/2010 Nemoto ..... 439/260
7,892,002 B2 * 2/2011 Shen et al. ..... 439/260
2003/0220013 A1 * 11/2003 Lee ..... 439/495

FOREIGN PATENT DOCUMENTS

TW M284122 12/2005

* cited by examiner

*Primary Examiner* — Tulsidas C Patel
*Assistant Examiner* — Travis Chambers
(74) *Attorney, Agent, or Firm* — J.C. Patents

(57) ABSTRACT

A connector module and a connector are provided. The connector module includes a connector and a flat cable. The connector includes a body, a terminal assembly, a cover and two protecting members. The body is formed with a connection space. The terminal assembly is disposed in the connection space. The cover is pivoted to the body and adapted to cover the connection space. The cover is adapted to be opened or closed relative to the body along a rotational path. The protecting members are pivoted to the body and respectively located on two sides of the terminal assembly, and are adapted to move between a first position and a second position. The flat cable is inserted into the terminal assembly so as to be electrically connected to the connector.

8 Claims, 3 Drawing Sheets

CONNECTOR MODULE AND CONNECTOR

CROSS-REFERENCE TO RELATED APPLICATION

This application claims the priority benefit of China application serial no. 201110386608.9, filed on Nov. 29, 2011. The entirety of the above-mentioned patent application is hereby incorporated by reference herein and made a part of this specification.

BACKGROUND OF THE INVENTION

1. Field of the Invention

The present invention generally relates to a connector module, in particular, to a connector module capable of preventing poor assembly between a flat cable and a connector, and a connector.

2. Description of Related Art

Along with the development of technologies and the widespread of computer systems, more and more people use computer systems to process documents, browse the Internet, play audio/video files, or store data, and accordingly computer systems have become one of the most indispensable tools in modern daily life.

Desktop computers, notebook computers or audio/video playback devices all have a circuit board, and various electronic elements are provided on the circuit board to implement difference functions. Moreover, the circuit board may be provided with some connector modules for connecting computer peripherals such as a hard disk, an optical disk drive, a keyboard, a mouse or a flash drive.

For a flat flexible flat cable (FFC) connector module or flexible printed circuitry (FPC) connector module, generally the connector module has a connector and a flat cable. In the assembly process, the flat cable is inserted and fixed to the connector. However, due to some man-made factors or alignment problems, skewed insertion often occurs, resulting in poor contact between the flat cable and the terminal assembly of the connector.

SUMMARY OF THE INVENTION

Accordingly, the present invention is directed to a connector module, which can effectively prevent poor contact caused by poor assembly between a flat cable and a connector.

The present invention provides a connector module, which includes a connector and a flat cable. The connector includes a body, a terminal assembly, a cover and two protecting members. The body is formed with a connection space. The terminal assembly is disposed in the connection space. The cover is pivoted to the body and adapted to cover the connection space. The cover is adapted to be opened or closed relative to the body along a rotational path. The protecting members are pivoted to the body and respectively located on two sides of the terminal assembly, so that the protecting members move between a first position and a second position. The flat cable is inserted into the terminal assembly so as to be electrically connected to the connector.

The present invention further provides a connector, where a flat cable is adapted to be assembled to the connector to form a connector module. The connector includes a body, a terminal assembly, a cover and two protecting members. The body is formed with a connection space. The terminal assembly is disposed in the connection space. The flat cable is inserted into the terminal assembly so as to be electrically connected to the connector. The cover is pivoted to the body and adapted to cover the connection space. The cover is adapted to be opened or closed relative to the body along a rotational path. The protecting members are pivoted to the body and respectively located on two sides of the terminal assembly, so that the protecting members move between a first position and a second position.

In an embodiment of the present invention, each protecting member has a pivot, a stopping portion and a driving portion, the protecting member is pivoted to the body through the pivot, the stopping portion is not located on the rotational path when the protecting member is located at the first position, the stopping portion is located on the rotational path and adapted to interfere with the cover when the protecting member is located at the second position, and the flat cable is adapted to push the driving portion of the protecting member, so that the protecting member moves from the second position to the first position, and the cover is closed relative to the body.

In an embodiment of the present invention, a moment of the stopping portion of the protecting member is larger than a moment of the driving portion, so that the protecting member is driven from the first position to the second position.

In an embodiment of the present invention, the pivot, the stopping portion and the driving portion of the protecting member are integrally formed.

In an embodiment of the present invention, the protecting member further has an elastic member connected between the protecting member and the connector, so that the protecting member moves back and forth between the first position and the second position.

According to the above, the connector module of the present invention is designed to have two protecting members pivoted to two sides of the terminal assembly, so that in the process of assembling the flat cable to the connector, if the flat cable is inserted into an improper position, the stopping portions of the protecting members stop the cover from covering the terminal assembly, causing that the flat cable cannot be assembled to the connector. As such, the connector module of the present invention can effectively prevent poor contact caused by poor assembly between the flat cable and the connector.

In order to make the aforementioned and other objectives and advantages of the present invention comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
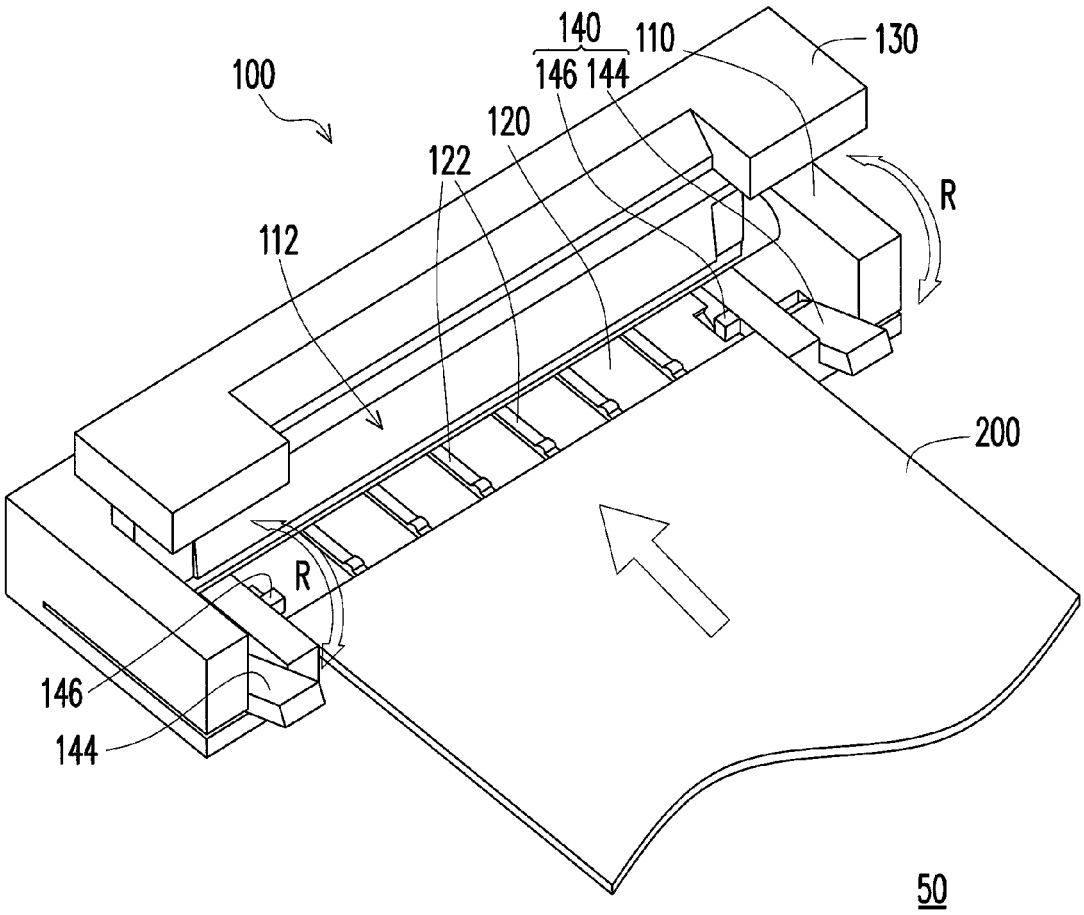
FIG. 1A is a schematic three-dimensional view of a connector module according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 1B:
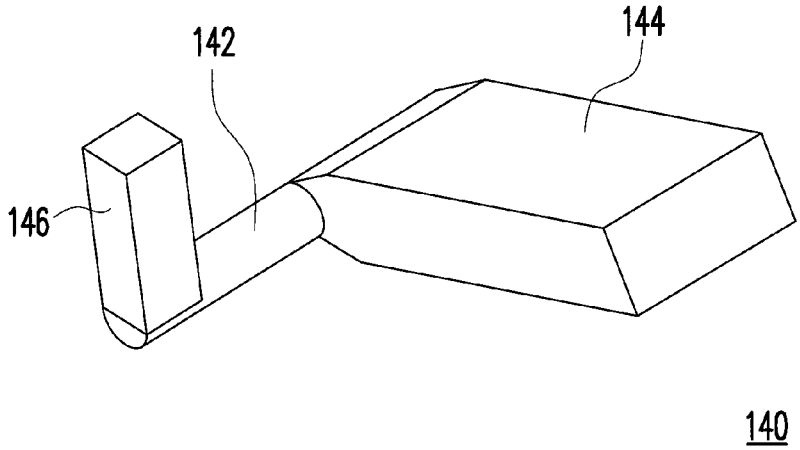
FIG. 1B is a schematic three-dimensional view of a protecting member of a connector of FIG. 1A.

FIG. 1A is a schematic three-dimensional view of a connector module according to an embodiment of the present invention. FIG. 1B is a schematic three-dimensional view of a protecting member of a connector of FIG. 1A. Referring to FIG. 1A and FIG. 1B, in this embodiment, the connector module 50 includes a connector 100 and a flat cable 200. Generally speaking, the connector module 50 is formed by assembling the flat cable 200 to the connector 100. The connector 100 of this embodiment includes a body 110, a terminal assembly 120, a cover 130 and two protecting members 140.

The terminal assembly 120 is used for inserting the flat cable 200 (direction of arrow) and being electrically connected to the flat cable 200, so the flat cable 200 has some contacts (not shown) therein and the terminal assembly 120 is configured with some gold fingers 122 for being electrically connected to the contacts of the flat cable 200. Generally speaking, when poor contact occurs between the contacts in the flat cable 200 and the gold fingers 122 of the terminal assembly 120, the connector module 50 after assembly is defective. Therefore, it is important to ensure good electrical connection between each contact of the flat cable 200 and each gold finger 122 of the terminal assembly 120.

Moreover, in this embodiment, the body 110 is formed with a connection space 112. The terminal assembly 120 is disposed in the connection space 112. The cover 130 is used for covering the terminal assembly 120 and fixing the flat cable 200 to the connector 100 after the flat cable 200 is inserted into the terminal assembly 120. The two protecting members 140 are used for stopping the cover 130 from covering the terminal assembly 120 when the flat cable 200 is inserted into the terminal assembly 120 in a skewed direction, so that the assembly of the flat cable 200 and the connector 100 cannot be completed. In other words, the cover 130 is adapted to be opened or closed relative to the body 110 along a rotational path R (referring to FIG. 1A).

Specifically, each protecting member 140 has a pivot 142, a stopping portion 144 and a driving portion 146. The two protecting members 140 are respectively pivoted to the connector 100 through the pivots 142 and located on two sides of the terminal assembly 120, so that each protecting member 140 moves between a first position P1 and a second position P2. In this embodiment, the first position P1 of the protecting member 140 is defined as the state of the protecting member 140 when the flat cable 200 has been correctly inserted into the terminal assembly 120, and the second position P2 of the protecting member 140 is defined as the state of the protecting member 140 when the flat cable 200 is not correctly inserted into the terminal assembly 120. In other words, when the protecting member 140 is located at the first position P1, the stopping portion 144 is not located on the rotational path R, and when the protecting member 140 is located at the second position P2, the stopping portion 144 is located on the rotational path R and interferes with the cover 130.

Furthermore, as shown in FIG. 1B, the driving portion 146 and the stopping portion 144 of the protecting member 140 are respectively located on two sides of the pivot 142. Moreover, the pivot 142, the stopping portion 144 and the driving portion 146 of the protecting member 140 may be integrally formed. In this embodiment, the protecting member 140 has such a design that if the pivot 142 is used as a fulcrum, a moment of the stopping portion 144 is larger than a moment of the driving portion 146, so that the protecting member 140 is driven from the first position P1 to the second position P2. In other words, in this embodiment, the mass of the stopping portion 144 of the protecting member 140 is larger than the mass of the driving portion 146, so that when no force is applied to the driving portion 146, the stopping portion 144 tends to maintain at the second position P2 under the gravity.

Figure 2A:
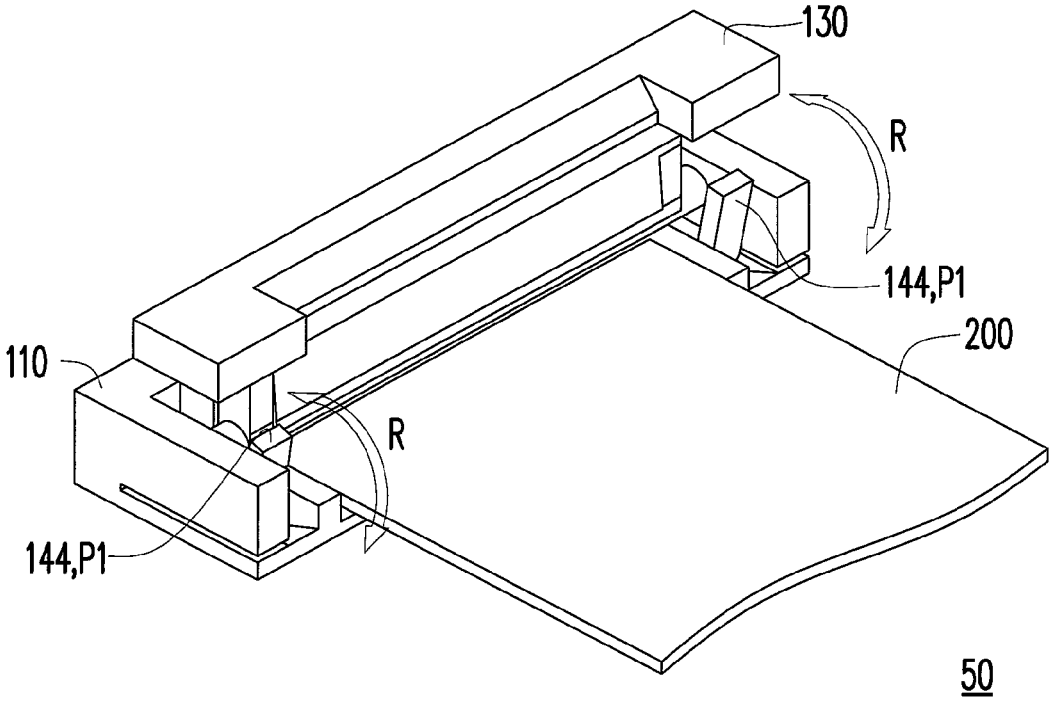
FIG. 2A is a schematic view illustrating that the protecting members of the connector module of FIG. 1A are located at the first position.
Figure 2B:
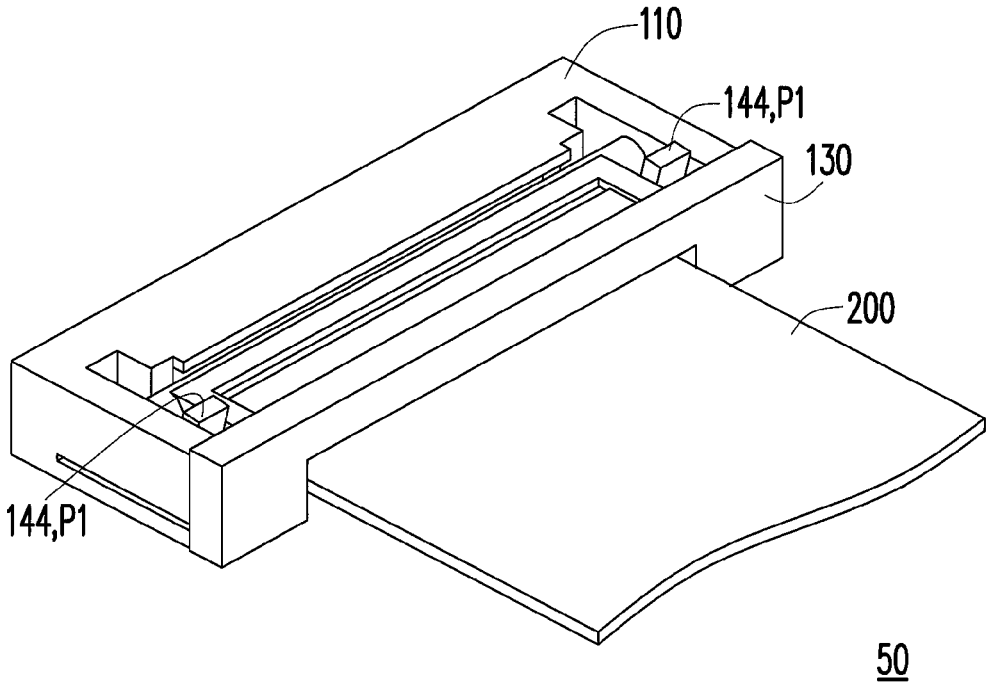
FIG. 2B is a schematic view of the connector module of FIG. 1A after being correctly assembled.

FIG. 2A is a schematic view illustrating that the protecting members of the connector module of FIG. 1A are located at the first position. FIG. 2B is a schematic view of the connector module of FIG. 1A after being correctly assembled. Referring to FIG. 2A, when the flat cable 200 is inserted into the terminal assembly 120, the inserted end of the flat cable 200 pushes the driving portions 146 of the protecting members 140 pivoted to two sides of the terminal assembly 120, and when the driving portions 146 are pushed over by the flat cable 200, the stopping portion 144 is actuated to stand, that is, the stopping portion 144 are actuated to be outside the path along which the cover 130 is opened or closed relative to the connector 100. As such, as shown in FIG. 2A and FIG. 2B, as long as the flat cable 200 is correctly inserted into the terminal assembly 120, the cover 130 can cover the terminal assembly 120 and fix the flat cable 200 to the connector 100 without being interfered by the stopping portions 144.

It should be noted that, in this embodiment, the two protecting member 140 are disposed independent of each other on two sides of the terminal assembly 120, and the protecting member 140 are not connected. Through such a configuration, when the flat cable 200 is inserted into the terminal assembly 120, even if an edge is inserted in a skewed direction or incorrectly, the stopping portion 144 may be located on the rotating path along which the cover 130 is opened or closed relative to the connector 100 to form a structural interference.

Figure 3:
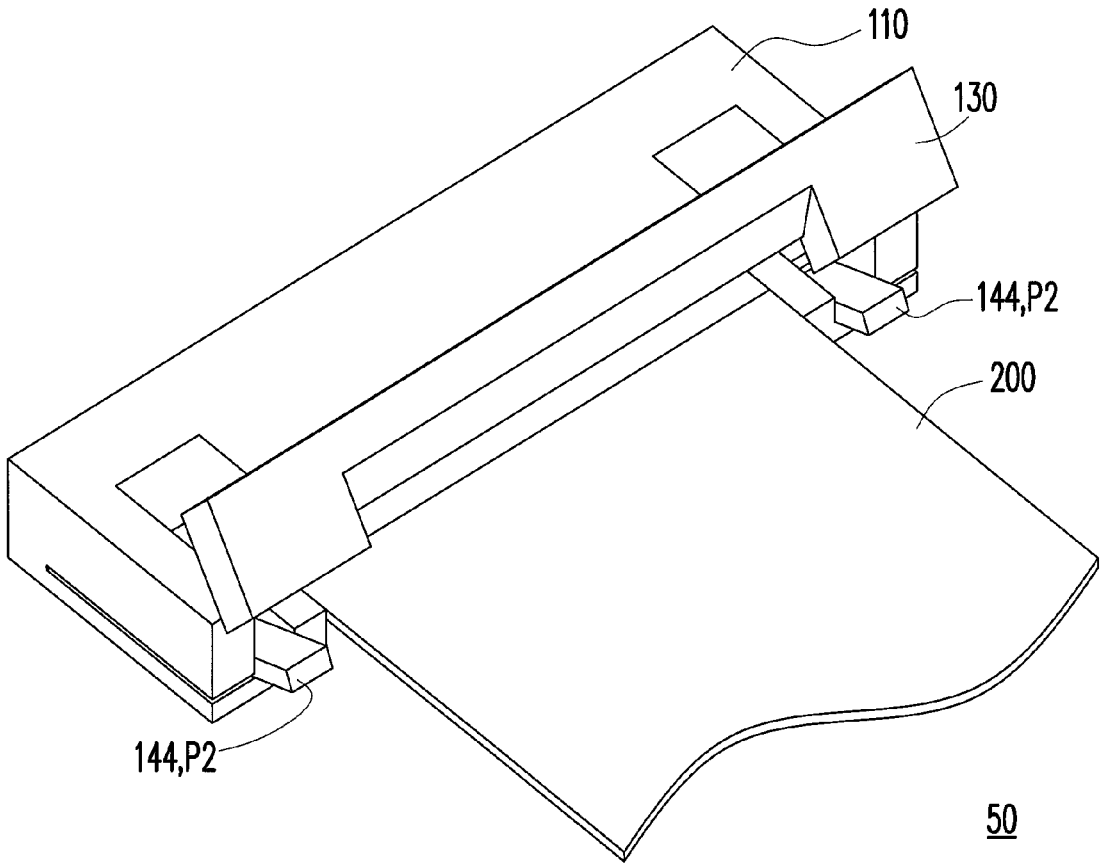
FIG. 3 shows that the connector module of FIG. 1A is assembled incorrectly and the assembly cannot be completed due to interference of the stopping portions.

FIG. 3 shows that the connector module of FIG. 1A is assembled incorrectly and the assembly cannot be completed due to interference of the stopping portions.

Referring to FIG. 3, when the flat cable 200 is not inserted into the terminal assembly 120 or is inserted into the terminal assembly 120 in a skewed direction, the inserted end of the flat cable 200 does not push the driving portion 146, and accordingly, the stopping portion 144 is located on the path along which the cover 130 is opened or closed relative to the connector 100 to form a structural interference. As such, the problems such as poor contact of the contacts of the flat cable 200 and the gold fingers 122 of the terminal assembly 120 due to incorrect assembly of the flat cable 200 and the connector 100 can be avoided, thereby ensuring that when the cover 130 covers the terminal assembly 120 and fixes the flat cable 200 to the connector 100, every contact of the flat cable 200 is electrically connected every corresponding gold finger 122 of the terminal assembly 110. Therefore, in this embodiment, the mechanical interference of the protecting members 140 can ensure correct electrical connection between the flat cable 200 and the connector 100, thereby ensuring the quality of the connector module 50.

Figure 4:
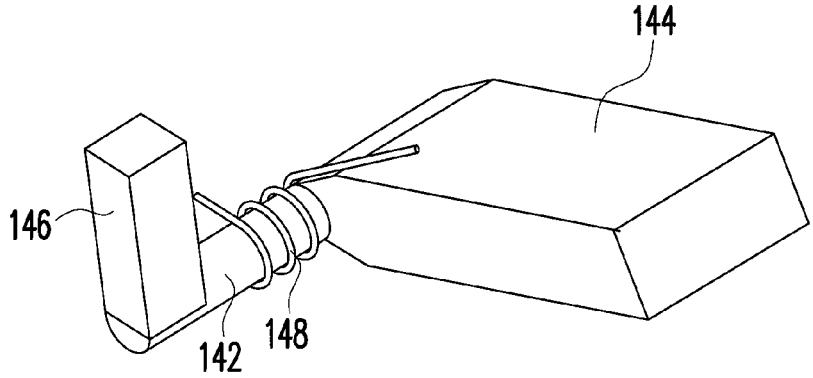
FIG. 4 is a schematic view of another reset mechanism of the protecting member of the connector module of FIG. 1A.

FIG. 4 is a schematic view of another reset mechanism of the protecting member of the connector module of FIG. 1A. Referring to FIG. 4, different from the above method where the mass of the stopping portion 144 is larger than the mass of the driving portion 146 so that the protecting member 140 is driven from the first position P1 to the second position P2, an elastic member 148 is used to connect the protecting member 140 to the connector 100, which also can enable the stopping portion 144 to reset from the first position P1 to the second position P2. In this embodiment, the elastic member 148 may be a torsion spring. Specifically, as shown in FIG. 4, the torsion spring may be sleeved over the pivot 142 of the protecting member 140 in such a manner that one end of the torsion spring urges against the stopping portion 144, and the other end of torsion spring is located between the pivot 142 and the connector 100 and urges against the connector 100, so that the stopping portion 144 tends to maintain at the second position P2. Therefore, the mechanical interference of the protecting members 140 can ensure the quality of assembly of the flat cable 200 and the connector 100.

Based on the above, the connector module of the present invention is designed to have two protecting members pivoted to two sides of the terminal assembly, so that in the process of assembling the flat cable to the connector, if the flat cable is inserted into an improper position, the stopping portions of the protecting members form a mechanical interference on the path along which the cover covers the terminal assembly, causing that the flat cable cannot be assembled to the connector. In addition, the protecting member of the connector module of the present invention has a simple structural design and is convenient to assemble. As such, the connector module of the present invention not only can effectively prevent poor contact caused by poor assembly between the flat cable and the connector, but also can greatly improve the product yield.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector module, comprising:

a connector, comprising:

a body, formed with a connection space;

a terminal assembly, disposed in the connection space;

a cover, pivoted to the body and adapted to cover the connection space, wherein the cover is adapted to be opened or closed relative to the body along a rotational path; and two protecting members, pivoted to the body and respectively located on two sides of the terminal assembly, and adapted to move between a first position and a second position; and a flat cable, inserted into the terminal assembly so as to be electrically connected to the connector wherein each protecting member has a pivot, a stopping portion and a driving portion, the protecting member is pivoted to the body through the pivot, the stopping portion is not located on the rotational path when the protecting member is located at the first position, the stopping portion is located on the rotational path and adapted to interfere with the cover when the protecting member is located at the second position, and the flat cable is adapted to push the driving portion of the protecting member, so that the protecting member moves from the second position to the first position, and the cover is closed relative to the body.

2. The connector module according to claim 1, wherein a moment of the stopping portion of the protecting member is larger than a moment of the driving portion, so that the protecting member is driven from the first position to the second position.

3. The connector module according to claim 1, wherein the pivot, the stopping portion and the driving portion of the protecting member are integrally formed.

4. The connector module according to claim 1, wherein the protecting member further has an elastic member connected between the protecting member and the connector, so that the protecting member moves back and forth between the first position and the second position.

5. A connector, wherein a flat cable is adapted to be assembled to the connector to form a connector module, the connector comprising:

a body, formed with a connection space;

a terminal assembly, disposed in the connection space, wherein the flat cable is into the terminal assembly so as to be electrically connected to the connector;

a cover, pivoted to the body and adapted to cover the connection space, wherein the cover is adapted to be opened or closed relative to the body along a rotational path; and two protecting members, pivoted to the body and respectively located on two sides of the terminal assembly, and adapted to move between a first position and a second position wherein each protecting member has a pivot, a stopping portion and a driving portion, the protecting member is pivoted to the body through the pivot, the stopping portion is not located on the rotational path when the protecting member is located at the first position, the stopping portion is located on the rotational path and adapted to interfere with the cover when the protecting member is located at the second position, and the flat cable is adapted to push the driving portion of the protecting member, so that the protecting member moves from the second position to the first position, and the cover is closed relative to the body.

6. The connector according to claim 1, wherein a moment of the stopping portion of the protecting member is larger than a moment of the driving portion, so that the protecting member is driven from the first position to the second position.

7. The connector according to claim 1, wherein the pivot, the stopping portion and the driving portion of the protecting member are integrally formed.

8. The connector according to claim 5, wherein the protecting member further has an elastic member connected between the protecting member and the connector, so that the protecting member moves back and forth between the first position and the second position.

* * * * *